United States Patent [19]

Budlane

[11] 3,961,300

[45] June 1, 1976

[54] THERMAL TIMER, THERMAL ACTUATOR, CONTROL SYSTEM AND CIRCUIT

[75] Inventor: Stanley J. Budlane, Fulton, Ill.

[73] Assignee: General Electric Company, Fort Wayne, Ind.

[22] Filed: June 18, 1974

[21] Appl. No.: 480,562

[52] U.S. Cl. ..... 337/303; 337/100; 337/107

[51] Int. Cl.[2] ..... H01H 37/02

[58] Field of Search ..... 337/93, 126, 127, 131, 337/135, 139, 141, 302, 303, 107

[56] References Cited

UNITED STATES PATENTS 1,684,709 9/1928 Lowenstein ..... 337/107

2,896,051 7/1959 Taylor ..... 337/131

*Primary Examiner*—R. N. Envall, Jr.
*Assistant Examiner*—Fred E. Bell
*Attorney, Agent, or Firm*—Joseph E. Papin

[57] ABSTRACT

A thermal timer has a pair of means responsive to oppositely acting thermal differentials established therebetween for pivotally moving generally in opposite directions through a predetermined time cycle.

A thermal control system, and circuit for operating an electrical device, and a thermal actuator for a thermal timer are also disclosed.

12 Claims, 4 Drawing Figures

THERMAL TIMER, THERMAL ACTUATOR, CONTROL SYSTEM AND CIRCUIT

BACKGROUND OF THE INVENTION

This invention relates generally to cyclical timers for electrical devices and in particular to a thermal timer, a thermal control system, a circuit for operating an electrical device, and a thermal actuator for a thermal timer.

In the past, various and sundry cyclical timers have been utilized to control the energization of many different types of electrical devices. Some of the well known past cyclical timers were operated by motor driven cams, and other such past cyclical timers were switch operated. Of course, a motor, either electric or spring driven, was commonly utilized to drive some of these past cyclical timers. In other past cyclical timers, a bimetal element was cyclically heated and cooled to actuate a switch for controlling a circuit for an electrical device.

One of the disadvantageous or undesirable features of some of the past cyclical timers is believed to be that it was difficult to predeterminately attain desired on-off periods or timers of generally equal duration. Another disadvantageous or undesirable feature of some of the past cyclical timers is believed to be that it was difficult to attain timing characteristics in which both the on-off periods or times are extremely short. Another disadvantageous or undesirable feature of some of the past cyclical timers is believed to be that they had to be calibrated or adjusted to compensate for ambient temperature. Still another disadvantageous or undesirable feature of some of the past cyclical timers is believed to be that they did not readily dissipate heat and were therefore rather slow acting. And yet another disadvantageous or undesirable feature of some of the past cyclical timers is believed to be that it was necessary to drive them with a motor thereby to increase the complexity and cost of those past cyclical timers.

SUMMARY OF THE INVENTION

Among the several objects and advantageous features of the present invention may be noted the provision of a thermal timer, a thermal control system, a circuit for operating an electrical device, and a thermal actuator for a thermal timer which overcome the disadvantageous or undesirable features discussed hereinbefore, as well as others, with respect to past cyclical timers; the provision of such thermal timer, thermal control system, and circuit in which on-off periods of extremely short duration may be readily and accurately attained; the provision of such thermal timer, thermal control system, circuit, and thermal actuator which are non-responsive to changes in ambient temperature; and the provision of such thermal timer, thermal control system, circuit, and thermal actuator which are simplistic in design, economical to manufacture and easily assembled. Other objects and features of the present invention will be in part apparent and in part pointed out hereinafter.

In general and in one form of the invention, a thermal timer has a housing, and means responsive to oppositely acting thermal differentials established thereacross for pivotally moving generally in opposite directions through a predetermined timed cycle. The pivotally moving means includes: a pair of generally elongate metallic strips disposed at least in part in spaced overlaying relation with each other; a pair of opposite end portions on each of the strips with one of the opposite end portions of the strips being interconnected; and means fixedly connected between the other of the opposite end portions for spacing them apart so that the spacing means and the strips constitute a generally triangularly shaped integral truss. Means is provided for mounting only the spacing means to the housing so that the strips may pivotally move generally in opposite directions about the spacing means. A pair of means are respectively associated with the strips and are adapted to be energized for alternately heating the strips to establish the thermal differentials thereacross and effect the pivotal movement of the strips in the opposite directions about the spacing means and through the predetermined timed cycle.

More particularly but still in general, a thermal timer in one form of the invention is provided with a housing having a shoulder therein. A pair of elongate strips of like metal are disposed generally in overlaying relation with each other in the housing, and the strips respectively have opposite end portions. One of the adjacent opposite end portions are interconnected, and means is interconnected between the other of the adjacent opposite end portions for spacing them apart so that the spacing means and strips constitute a generally triangularly shaped truss. Means is provided for mounting at least the spacing means to the housing shoulder wherein the strips may be pivotally moved generally about the spacing means. A pair of means are respectively mounted on the strips and adapted to be electrically energized for alternately heating the strips to establish oppositely acting thermal differentials therebetween and effect the pivotal movement of the strips generally in opposite directions. A pair of spaced contacts are electrically connected with the heating means and mounted to at least one of the strips generally adjacent the one adjacent opposite end portions thereof. An electrical switch is mounted to the housing and is adapted for snap-action movement to control the energization of the heating means. The electrical switch includes a resilient switch blade extending generally between the spaced contacts, and a switch contact is provided on the switch blade for making and breaking engagement with the spaced contacts. The switch blade normally urges the switch contact into making engagement with one of the spaced contacts. The electrical switch is initially operable to transmit power supplied thereto through the one spaced contact to energize one of the heating means establishing the thermal differential between the strips. The established thermal differential effects pivotal movement of the strips in one of the opposite directions toward a position causing snap-action movement of the switch contact from the one spaced contact thereby to deenergize the one heating means and into making engagement with the other of the spaced contacts. The electrical switch is thereafter operable to transmit the power through the other spaced contact to energize the other of the heating means establishing another thermal differential between the strips. The other thermal differential acts generally opposite to the first-named thermal differential to effect pivotal movement of the strips generally in the other of the opposite directions.

Also in general and in one form of the invention, a thermal control system for an electrical device has a circuit for energizing the electrical device. Means is provided for controlling the circuit and includes: a pair of generally elongate metallic strips with adjacent pairs of opposite end portions thereof interconnected; and stationary means having a part for mounting and another part fixedly disposed in spacing relation between one of the adjacent pairs of opposite end portions so as to integrally form with the strip a generally triangularly shaped truss with the strips adapted to be conjointly thermally driven generally pivotally in opposite directions about the stationary means. A pair of spaced apart switching components are mounted to the strips adjacent the other of the adjacent pairs of opposite end portions and operable generally periodically upon the pivoting of the strips in the opposite directions to open and close the circuit upon the energization thereof. A pair of means are alternately connected in the circuit in response to the periodic operation of the switching components for respectively heating the strips to effect their pivotal movement in the opposite directions about the stationary means and the periodic operation of the switching components.

Still further and in general, a circuit in one form of the invention is provided for operating an electrical device. In this circuit, means is adapted to be thermally driven between a pair of circuit controlling positions, and the thermally driven means includes: a pair of metallic strips having adjacent pairs of opposite end portions with one of said adjacent end portion pairs being interconnected; and stationary means fixedly connected with the other of the adjacent end portion pairs in spacing relation therebetween so as to constitute with the strips a generally triangularly shaped truss with the strips adapted to be conjointly pivotal in opposite directions about the stationary means between the circuit controlling positions. A pair of means connected in parallel circuit relation are operable generally for selectively heating the strips. One of the heating means is operable upon energization thereof to heat one of the strips for driving the thermally driven means from one of the circuit controlling positions to the other thereof, and the other of the heating means is operable upon the energization thereof to heat the other of the strips for driving the thermally driven means from the other circuit controlling position to the one thereof. Means is provided for connecting the electrical device in parallel circuit relation with one of the one and other heating means so as to be conjointly energized therewith upon the movement of the thermally driven means to one of the one and other circuit controlling positions. Means is also provided for selectively placing the electrical device and the heating means across a source of power wherein the conjoint energization of the electrical device and the one of the one and other heating means is effected when the thermally driven means is in the one of the one and other circuit controlling positions. Only the energization of the other of the one and other heating means is effected when the thermally driven means is in the other of the one and other circuit controlling positions thereof.

Also in general, a thermal actuator in one form of the invention includes a pair of elongate metallic strips disposed closely adjacent each other and generally in overlaying relation. A pair of oppositely spaced end portions are provided on each of the strips with the adjacent end portion pairs thereof being respectively interconnected. A spacer has a portion for mounting it and another portion fixedly connected in spacing relation between one of the adjacent end portion pairs so as to constitute with the strips a generally triangularly shaped truss with the other of the adjacent end portion pairs adapted to be pivotally movable relative generally about the other portion of the spacer in opposite directions. A pair of means is disposed on the strips for heating them alternately, and the alternately heated one of the strips is adapted to elongate relative to the other of the strips for effecting the pivotal movement of the other adjacent end portion pairs about the other portion of the spacer.

BRIEF DESCRIPTION OF THE DRAWINGS

Corresponding reference characters indicate corresponding parts throughout the several views of the drawings.

Figure 1:
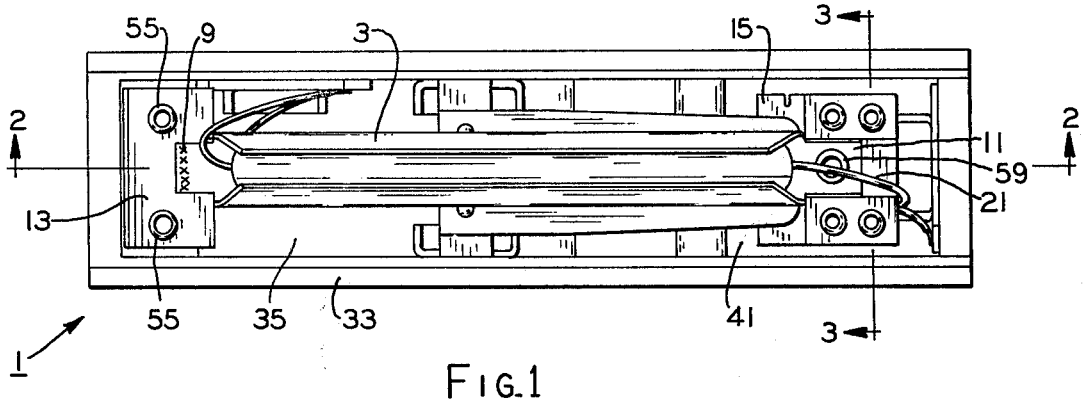
FIG. 1 is a plan view of a thermal timer in one form of the invention having its cover removed to show a thermal actuator also in one form of the invention.

The following examples illustrate the invention and are not to be construed as limiting in any manner.

DETAILED DESCRIPTION OF THE PREFERRED EMBODIMENTS

Referring now to the drawings in general, there is illustrated a method for operating a thermal timer 1 (FIGS. 1–4). In this method, a pair of means, such as generally elongate members or metallic strips **3, 3*a*, adapted to be pivotally movable are alternately heated and cooled in a predetermined time relation for establishing oppositely acting differentials between the pivotally movable means or members 3, 3*a*. The establishment of these oppositely acting thermal differentials effects the pivotal movement of members 3, 3*a*** generally in opposite directions through a predetermined timed cycle.

Figure 2:
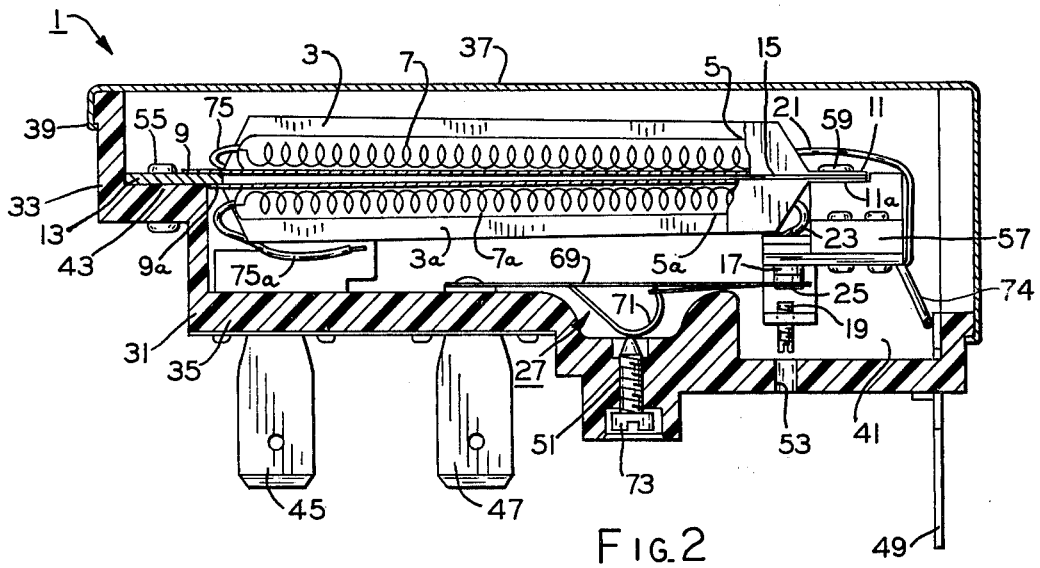
FIGS. 2 and 3 are sectional views generally taken along lines 2—2 and 3—3 of FIG. 1.

More particularly and with specific reference to FIGS. 1 and 2, members **3, 3*a* are formed from like metal preferably having relatively high thermal coefficient of expansion, and these members along with other components associated therewith, as discussed in detail hereinafter, generally constitute a thermal actuator in one form of the invention. Since each of member 3, 3*a* have generally the same configuration and are formed from like metal, it may be noted that they are generally unaffected by the ambient temperature in which they are placed or by changes in the ambient temperature. Further, members 3, 3*a* are generally U-shaped in cross-section thereby to provide rather large surface areas for enhancing heat transfer or dissipation to the atmosphere, as discussed hereinafter. While members 3, 3*a* are illustrated as generally U-shaped, it is contemplated that such members having various other cross-sectional configurations may be utilized within the scope of the invention. The generally U-shaped configurations of members 3, 3*a* define channels 5, 5*a* extending generally in the lengthwise direction of the members, and a pair of means, such as electrical resistance heaters or coils 7, 7*a*, for heating the members are disposed in the channels, respectively. While electrical heaters 7, 7*a* are illustrated generally in a coil form, it is contemplated that such heaters may be provided in other shapes and also that different types of heaters, such as a positive temperature coefficient resistor or the like, may be utilized within the scope of the invention. A suitable dielectric material preferably having good thermal conductive properties may also be interposed between heaters 7, 7***a* and members 3, 3*a* for electrical insulation purposes.

Members 3, 3*a* are respectively provided with opposite end portions 9, 11 and 9*a*, 11*a*, and means, such as spacers 13, 15, are interposed between adjacent opposite end portions 9, 9*a* and 11, 11*a* for predeterminately spacing or separating them. It may be noted that spacing means or spacer 13 is predeterminately thicker than spacer 15, and the spacers are fixedly interposed or interconnected between opposite end portions 9, 9*a* and 11, 11*a* by suitable means, such as riveting, welding or soldering or the like. The difference in thickness between spacers 13, 15 is provided not only for strength and mounting purposes, as discussed hereinafter, but also to effect or form a truss having a generally triangular configuration or shape when the spacers are fixedly interposed between adjacent opposite end portions 9, 9*a* and 11, 11*a* of members 3, 3*a*. The added strength of spacer 13 between adjacent opposite end portions 9, 9*a* permits the spacer to be mounted so that members 3, 3*a* are generally conjointly pivotally movable in opposite directions relative to the spacer in response to alternate energization of heaters 7, 7*a*, as discussed hereinafter. It is also contemplated that adjacent opposite end portions 11, 11*a* of members 3, 3*a* may be welded or otherwise fixedly connected together omitting the use of spacer 15 therebetween within the scope of this invention.

A pair of spaced contacts 17, 19 are provided on members 3, 3*a* for conjoint pivotal movement therewith, and the contacts are electrically connected by suitable means, such as electrical leads 21, 23, with heaters 7, 7*a*. Another or switch contact 25 is provided on an over-center or snap-acting toggle switch assembly 27, and the switch contact is normally urged by the switch assembly toward making engagement with spaced contact 17. When the thermal timer 1 is energized, as discussed in greater detail hereinafter, power may flow through switch assembly 27, spaced and switch contacts 17, 25 in making engagement and lead 23 to energize heater 7. Upon energization of heater 7, heat is conducted or transmitted therefrom to member 3 causing it to elongate relative to the relatively cool member 3*a*. Thus, the thermal differential created between members 3, 3*a* effects conjoint pivotal movement thereof generally about spacer 13 in a clockwise direction (as seen in FIG. 2) driving switch assembly 27 therewith. When this pivotal movement of members 3, 3*a* drives switch assembly 27 to its over-center position, the switch assembly is operable to move its contact 25 with snap-action from engagement with spaced contact 17 into making engagement with spaced contact 19. Of course, this making and breaking engagement of switch contact 25 with spaced contacts 17, 19 interrupts the flow of power to heater 7 and flows power to heater 7*a* for effecting alternate energization thereof. Power flows through switch assembly 27, spaced and switch contacts 19, 25 in making engagement and lead 21 to heater 7*a*. The interruption of power to heater 7 effects relatively quick cooling thereof along with member 3, and the alternate energization of heater 7*a* effects heat transfer or conduction therefrom to member 3*a* heating it. Heating of member 3*a* effects elongation thereof relative to member 3 which is cooling and contracting; therefore, this thermal differential acting across the members in a direction generally opposite to the thermal differential mentioned hereinbefore terminates the conjoint pivotal movement of the members in the clockwise direction and effects conjoint pivotal movement of the members generally in a counterclockwise or reverse direction (as seen in FIG. 2). In this manner, it may be noted that alternately switching of power between heaters 7, 7*a* is effective to cyclically drive members 3, 3*a* between a pair of opposite circuit controlling positions in which switch assembly 27 is also effective to cause the alternate energization of heaters 7, 7*a* thereby to predetermine a timed cycle of the member as they are pivotally or reciprocally moved between their circuit controlling positions.

Referring now again to the drawings in general, thermal timer 1 in one form of the invention is provided with a pair of means, such as members 3, 3*a*, responsive to the oppositely acting thermal differential established therebetween for pivotally moving through the predetermined timed cycle. A pair of means, such as heaters 7, 7*a*, are respectively associated with the moving means or members 3, 3*a* and are adapted to be energized for alternately heating the members to establish the oppositely acting thermal differentials therebetween.

More particularly and with reference again to FIGS. 1 and 2, thermal timer 1 is provided with a housing 31 having side walls 33 integrally formed with a stepped base or lower end wall 35, and a cover 37 is attached by suitable means, such as snap over lips 39, to corresponding or mating portions on the upper of free ends of the side walls. A chamber 41 is provided within housing 31 and cover 37 in which the operable components of thermal timer 1 are disposed, and means, such as a shoulder 43, for mounting members 3, 3*a* is provided within the chamber and integrally formed on a side wall 33 of the housing. Terminals 45, 47, 49 are integrally molded in place and extend through housing base wall 35, but it is contemplated that other types of terminals may be attached to the housing by other suitable means within the scope of the invention. A threaded adjusting screw receiving aperture or opening 51 is provided through housing base wall 35 adjacent the mid-portion thereof, and a tool insertion aperture or opening 53 is also provided in the housing base wall spaced rightwardly of opening 51 therein.

Figure 3:
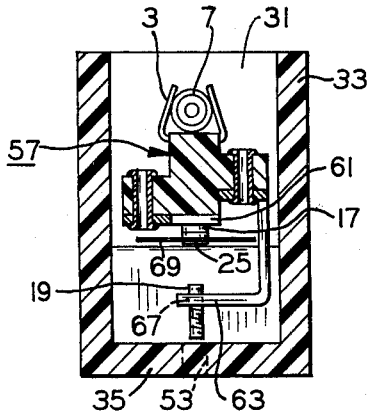

As may be recalled, members 3, 3*a* and spacers 13, 15 are assembled together so as to form a generally integral truss having a generally triangular configuration. A part of spacer 13 is mounted to housing shoulder 43 by suitable mounting or fastening means, such as rivets 55 or the like, so that members 3, 3*a* extend from another part of the spacer into housing chamber 41 generally parallel to housing base wall 35. Referring now also to FIG. 3, an electrical terminal block 57 is attached to spacer 15 by suitable fastening means, such as rivet 59 or the like, and a pair of switching components, such as metallic terminal strips or legs 61, 63, are connected by suitable means to the terminal block. Leg 63 is shaped so as to have a portion thereof extending into spaced overlaying relation with leg 61. Spaced contact 17 is mounted by suitable means, such as soldering or riveting or the like, to upper leg 61, and a threaded opening 67 is provided in lower leg 63 generally opposite to spaced contact 17. Spaced contact 19 is constituted by a threaded adjustable screw or plug which is threadedly received in opening 67 so as to be in electrical conducting engagement with lower leg 63 and adjustably spaced opposite spaced contact 17. Spaced contact 19 is predisposed with respect to opening 53 in housing base wall 35, and a tool (not shown) may be inserted through the opening into adjusting engagement with spaced contact 19 to adjustably predetermined its spaced relation with respect to spaced terminal 17.

Switch assembly 27 is of a conventional, over-center, snap-acting toggle type well known to the art having a resilient switch blade 69 with one end electrically and pivotally connected by suitable means, such as a rivet or the like, to the interior end of housing terminal 47. The other or free movable end of switch blade 69 extends between spaced contacts 17, 19 carried by terminal block 57, and switch contact 25 is mounted on the free end of the switch blade for making and breaking engagement with the spaced contacts. A resilient portion, such as a biasing or toggle spring 71, is lanced from switch blade 69 and tensioned with respect thereto, and the biasing spring is disposed above threaded opening 51 in housing base wall 35. An adjusting screw 73 is threadedly received in base wall opening 51 and adjustably movable therein into abutting or tensioning engagement with switch biasing spring 71 thereby to predetermine the force necessary for moving switch blade 69 with snap-action between its respective circuit controlling positions in which switch contact 25 is in making engagement with spaced contacts 17, 19, respectively. The cycle rate of thermal timer 1 may be adjusted to a predetermined time by varying the force applied by adjusting screw 73 on biasing spring 71 of switch assembly 27, and spaced contact 19 may be adjusted to vary the gap between it and spaced contact 17 to effect and maintain a given cycle rate. It is also contemplated that the wattage of heaters 7, 7*a* may also be varied as an alternate method of maintaining the cycle rate of thermal timer 1 within the scope of the invention. To complete the description of thermal timer 1, a lead 74 is electrically connected between terminal block 57 and housing terminal 49, and a pair of leads 75, 75*a* are respectively connected between heaters 7, 7*a* and the interior end of housing terminal 45.

Referring now again to the drawings in general, there is illustrated generally at 77 (FIG. 4) a thermal control system in one form of the invention for an electrical device, such as a permanent split capacitor motor 79 or the like. In system 77, an electrical circuit, indicated generally at 81 is provided for energizing motor 79. Means for controlling circuit 81 includes means, such as members 3, 3*a*, adapted to be thermally driven and operable generally periodically to open and close the circuit upon the energization thereof, and a pair of means, such as heaters 7, 7*a*, are alternately connected in the circuit in response to the periodic operation of the thermally driven means or members 3, 3*a* for respectively heating it to effect its periodic operation (FIGS. 1 and 2).

In one form of the invention, there is generally shown circuit 81 for operating motor 79, and means, such as members 3, 3*a*, adapted to be thermally driven between a pair of circuit controlling positions. A pair of means, such as heaters 7, 7*a* are connected in parallel circuit relation and operable generally for selectively heating the thermally driven means or members 3, 3*a*. One of the heating means or heater 7 is operable upon energization thereof to heat thermally driven means 3, 3*a* for driving it from one of the circuit controlling positions to the other thereof, and the other of the heating means or heater 7*a* is operable upon energization thereof to also heat the thermally driven means for driving it from the other circuit controlling position to the one thereof. Means, such as at least a lead 83, is provided connecting motor 79 in parallel circuit relation with at least heater 7 for conjoint energization therewith. Means, such as an on-off or motor starting switch 85, is provided for placing motor 79 and heaters 7, 7*a* across a source of power, as illustrated by line terminals L1, L2, to effect the conjoint energization of motor 79 and heater 7 and alternately the energization of only heater 7*a* upon the cyclical or periodic operation of the thermally driven means between its circuit controlling positions.

OPERATION

Figure 4:
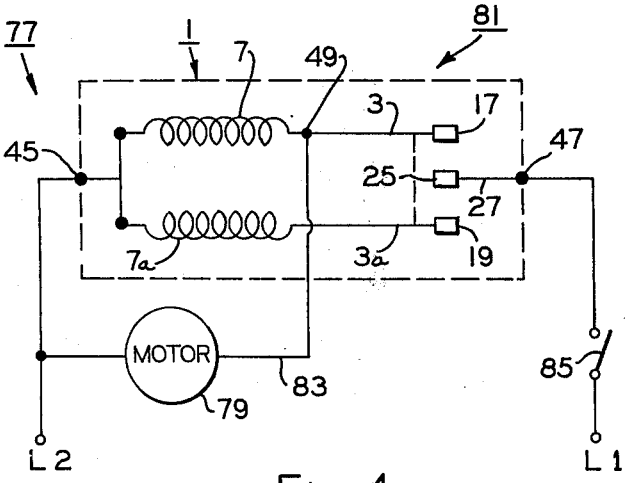
FIG. 4 is a schematic view of a circuit in one form of the invention for operating the thermal timer of FIG. 1 and generally illustrating a thermal control system also in one form of the invention.

In the operation with the component parts of thermal timer 1 positioned as above described and as shown in the drawings, the cyclical operation of the thermal timer is initiated by closure of motor starting switch 85 thereby to place circuit 81 across line terminals or power source L1, L2, FIG. 4. Initially, power flows from motor starting switch 85 through housing terminal 47, switch blade 69 of switch assembly 27, spaced and switch contacts 17, 25 in making engagement, and lead 23 to heater 7 effecting energization thereof, FIGS. 2 and 4. At the same time power also flows from terminal block 57 through lead 74 and housing terminal 49 to effect energization of motor 79 conjointly with heater 7. Assuming that member 3*a* is cool, heat generated upon energization of heater 7 is transferred to member 3 causing it to elongate generally to the right (as seen in FIG. 2). Thus, the heating of member 3 establishes a thermal differential or gradient with respect to the relatively cool member 3*a*. Such thermal differential effects expansion or elongation of member 3 generally to the right (as seen in FIG. 2) and relative to cool member 3*a* to thereby pivotally move the interconnected adjacent opposite end portions 11, 11*a* of the members about the generally stationary adjacent opposite end portions 9, 9*a* in a clockwise direction. In other words, when member 3 elongates, the interconnected adjacent opposite end portions 11, 11*a* are pivoted clockwise, i.e. generally downwardly, since member 3*a* and spacer 13, which form two sides of the aforementioned generally triangularly shaped truss, are constant while member 3, which forms the third side of the generally triangular truss, elongates.

It may be noted that such pivotal movement of members 3, 3*a* in response to the thermal differential established therebetween conjointly drives or pivotally moves switch blade 69 in a clockwise direction generally about its connection with the interior end of housing terminal 47 through the making engagement of switch contact 25 with spaced contact 17. When switch blade 69 is pivoted to its over-center position, it then moves with characteristic snap-action to disengage switch contact 25 from spaced contact 17 into making engagement with space contact 19 which generally defines one of the circuit controlling positions of switch assembly 27. Upon disengagement of switch contact 25 from spaced contact 17, the supply of power for conjointly energizing heater 7 and motor 79 is interrupted thereby to effect the conjoint de-energization thereof. Further, the making engagement of switch contact 25 with spaced contact 19 now effects a supply of power from motor starting switch 85 through housing terminal 47, spaced and switch contacts 19, 25 in making engagement, terminal block 57 and lead 21 to effect the alternate energization of heater 7a when heater 7 is deenergized, as discussed above.

When heater 7 is de-energized, member 3 cools so as to now become the relatively cool member as heat is transferred or otherwise conducted from the now energized heater 7a to member 3a. Thus, the heating of member 3a and the cooling of member 3 establishes another thermal differential or gradient between the members acting generally oppositely to the aforementioned thermal differential. This thermal differential is now effective to cause expansion or elongation of member 3a generally to the right as member 3 is contracting generally to the left (as seen in FIG. 2). In this manner, the aforementioned clockwise pivotal movement of members 3, 3a relative to spacer 13 is terminated and reversed so that the elongation of member 3a in response to the thermal differential now existing between the members effects pivotal movement thereof in a counterclockwise direction, i.e. generally upwardly as seen in FIG. 2. In other words, when member 3a elongates, the interconnected adjacent opposite end portions 11, 11a of members 3, 3a are pivoted in the counterclockwise direction since spacer 13 and the now relatively cool member 3, which form two sides of the aforementioned generally triangularly shaped truss, are generally constant while member 3a, which forms the third side of the truss, elongates.

It may be noted that the switching of power from heater 7 to heater 7a by switch assembly 27, as described above, is effective to define and/or limit the initial pivotal movement or travel of members 3, 3a in the clockwise direction thereby to predetermine that particular or initial part or portion of the timed cycle of the members and initiate the reversal or return pivotal movement or travel of the members in the counterclockwise direction through the return part or portion of the timed cycle. During this return pivotal movement of members 3, 3a in response to the thermal differential therebetween, the members conjointly drive switch blade 69 in a generally counterclockwise direction about its connection with the interior end of housing terminal 47 through the making engagement of spaced and switch contacts 19, 25. When switch blade 69 is pivoted to its over-center position, it moves switch contact 25 with snap-action from engagement with spaced contact 19 again into making engagement with spaced contact 17.

Upon the disengagement of switch contact 25 from spaced contact 19, the supply of power for energizing heater 7a is, of course, interrupted thereby to effect de-energization of the heater. Further, the subsequent re-making of switch contact 25 with spaced contact 17 again effects the supply of power from motor starting switch 85 through housing terminal 47, switch blade 69, re-made spaced and switch contacts 19, 25, terminal block 57 and lead 23 to cyclically re-energize heater 7 and motor 79. It may be noted that the switching of power from heater 7a to heater 7 by switch assembly 27, as described above, is effective to define and/or limit the return pivotal movement or travel of members 3, 3a in the counterclockwise direction thereby to predetermine that particular or return part or portion of the timed cycle of the members and re-establish the initial pivotal movement of the members in the clockwise direction through the initial portion of the timed cycle. Of course, thermal timer 1 will continue to cycle or operate periodically through its timed cycle, as described above, so long as motor starting switch 85 remains closed to complete circuit 81 across line terminals L1, L2.

In view of the foregoing, it is now submitted that a novel thermal timer 1, thermal control system 77, circuit 81, and a thermal actuator have been provided meeting the objects and advantages set out hereinbefore, as well as others. Further, it is contemplated that changes may be made in the precise arrangement, shapes, connections and details of the component parts of thermal timer 1, system 77, circuit 81 and the thermal actuator by those having ordinary skill in the art without departing from the spirit and scope of the invention which is defined by the claims which follow.

What I claim as new and desire to secure by Letters Patent of the United States is:

1. A thermal timer comprising a housing, means responsive to oppositely acting thermal differentials established thereacross for pivotally moving generally in opposite directions through a predetermined timed cycle including a pair of generally elongate metallic strips disposed at least in part in spaced overlaying relation with each other, a pair of opposite end portions on each of said strips, one of said opposite end portions of said strips being interconnected, and means fixedly connected between the other of said opposite end portions for spacing them apart so that said spacing means and said strips constitute a generally triangularly shaped integral truss, means for mounting only said spacing means to said housing so that said strips may pivotally move generally in the opposite directions about said spacing means, and a pair of means respectively associated with said strips and adapted to be energized for alternately heating said strips to establish the thermal differentials thereacross and effect the pivotal movement of said strips in the opposite directions about said spacing means and through the predetermined timed cycle.

2. A thermal timer as set forth in claim 1, wherein said heating means comprises a pair of resistance heaters.

3. A thermal timer as set forth in claim 1 wherein one of said heating means is energized to heat one of said strips while the other of said heating means and the other of said strips are cooler thereby to establish one of the oppositely acting thermal differentials across said strips for pivotally moving them in one of the opposite directions.

4. A thermal timer as set forth in claim 1 further comprising means actuated in response to the pivotal movement of said strips in the opposite directions for alternately switching the energization of said heating means.

5. A thermal timer as set forth in claim 1 further comprising a pair of spaced contacts on said moving means respectively electrically connected with said heating means and adapted to be alternately connected with a power source to effect the alternate energization of said heating means.

6. A thermal timer as set forth in claim 5 further comprising means responsive to the pivotal movement of said moving means in the opposite directions for respective making and breaking engagement with said spaced contacts to effect the alternate connection thereof with the power source.

7. A thermal timer comprising a housing having a shoulder therein, a pair of elongate strips of like metal disposed generally in overlaying relation with each other and respectively having opposite end portions, one of the adjacent opposite end portions being interconnected, means interconnected between the other of the adjacent opposite end portions for spacing them apart so that the spacing means and strips constitute a generally triangularly shaped truss, means for mounting at least the spacing means to the housing shoulder wherein the strips may be pivotally moved generally about the spacing means, a pair of means respectively mounted on the strips and adapted to be electrically energized for alternately heating the strips to establish oppositely acting thermal differentials therebetween and effect the pivotal movement of the strips generally in opposite directions, a pair of spaced contacts electrically connected with the heating means and mounted to at least one of the strips generally adjacent the one adjacent opposite end portion thereof, an electrical switch mounted to the housing and adapted for snap-action movement to control the energization of the heating means including a resilient switch blade extending generally between the spaced contacts, and a switch contact on the switch blade for making and breaking engagement with the spaced contacts and normally urged by the switch blade into making engagement with one of the spaced contacts, the electrical switch being initially operable to transmit power supplied thereto through the one spaced contact to energize one of the heating means establishing the thermal differential between the strips to effect pivotal movement thereof in one of the opposite directions toward a position causing snap-action movement of the switch contact from the one spaced contact thereby to de-energize the one heating means and into making engagement with the other of the spaced contacts, and the electrical switch being thereafter operable to transmit the power through the other spaced contact to energize the other of the heating means establishing another thermal differential between the strips acting generally opposite to the first named thermal differential to effect the pivotal movement of the strips generally in the other of the opposite directions.

8. A thermal control system for an electrical device comprising a circuit for energizing the electrical device, means for controlling said circuit including a pair of generally elongate metallic strips with adjacent pairs of opposite end portions thereof respectively interconnected, stationary means having a part for mounting and another part fixedly disposed in spacing relation between one of said adjacent pairs of opposite end portions so as to integrally form with said strips a generally triangularly shaped truss with said strips adapted to be conjointly thermally driven generally pivotally in opposite directions about said stationary means, a pair of spaced apart switching components mounted to said strips adjacent the other of said adjacent pairs of opposite end portions and operable generally periodically upon the pivoting of said strips in the opposite directions to open and close said circuit upon the energization thereof, and a pair of means alternately connected in said circuit in response to the periodic operation of said switching components for respectively heating said strips to effect their pivotal movement in the opposite directions about said stationary means and the periodic operation of said switching components.

9. A thermal control system as set forth in claim 8 wherein said heating means comprises a pair of resistance heaters connected in parallel with each other in said circuit.

10. A circuit for operating an electrical device comprising means adapted to be thermally driven between a pair of circuit controlling positions, said thermally driven means including a pair of metallic strips having adjacent pairs of opposite end portions, one of said adjacent end portion pairs being interconnected, stationary means fixedly connected with the other of said adjacent end portion pairs in spacing relation therebetween so as to constitute with said strips a generally triangularly shaped truss with said strips adapted to be conjointly pivotal in opposite directions about said stationary means between the circuit controlling positions, a pair of means connected in parallel circuit relation and operable generally for selectively heating said strips, one of said heating means being operable upon energization thereof to heat one of said strips for driving said thermally driven means from one of the circuit controlling positions to the other thereof and the other of said heating means being operable upon energization thereof to heat the other of said strips for driving said thermally driven means from the other circuit controlling position to the one thereof, means for connecting the electrical device in parallel circuit relation with one of said one and other heating means so as to be conjointly energized therewith upon the movement of said thermally driven means to one of the one and other circuit controlling positions, and means for selectively placing the electrical device and said heating means across a source of power wherein the conjoint energization of the electrical device and said one of said one and other heating means is effected when said thermally driven means is in the one of the one and other circuit controlling positions and only the energization of the other of said one and other heating means is effected when said thermally driven means is in the other of the one and other circuit controlling positions.

11. A thermal actuator comprising a pair of generally elongate metallic strips disposed closely adjacent each other and generally in overlaying relation, a pair of oppositely spaced end portions on each of said strips with adjacent end portion pairs thereof being respectively interconnected, a spacer having a portion for mounting it and another portion fixedly connected in spacing relation between one of said adjacent end portion pairs so as to constitute with said strips a generally triangularly shaped truss with the other of said adjacent end portion pairs adapted to be pivotally movable generally about said other portion of said spacer in opposite directions, and a pair of means disposed on said strips for heating them alternately, the alternately heated one of said strips being adapted to elongate relative to the other of said strips for effecting the pivotal movement of said other adjacent end portion pairs about said other portion of said spacer.

12. A thermal actuator as set forth in claim 11 further comprising a pair of stationary switch components electrically connected with said heating means and mounted to said strips adjacent said other adjacent end portion pairs so as to be conjointly pivotally movable with said strips for alternate connection with a power source to effect alternate energization of said heating means.

* * * * *